US009460882B2

(12) United States Patent
Enriquez et al.

(10) Patent No.: US 9,460,882 B2
(45) Date of Patent: Oct. 4, 2016

(54) LAMINATED ELECTRICAL FUSE

(71) Applicant: Littelfuse, Inc., Chicago, IL (US)

(72) Inventors: Albert Enriquez, Lipa (PH); Demetrio Criste, Lipa (PH); Conrado DeLeon, Lipa (PH); Crispin Zulueta, Lipa (PH); Roel Retardo, Lipa (PH); John Semana, Lipa (PH); Gordon Todd Dietsch, Park Ridge, IL (US)

(73) Assignee: Littelfuse, Inc., Chicago, IL (US)

( * ) Notice: Subject to any disclaimer, the term of this patent is extended or adjusted under 35 U.S.C. 154(b) by 233 days.

(21) Appl. No.: 13/826,058

(22) Filed: Mar. 14, 2013

(65) Prior Publication Data

US 2014/0266564 A1 Sep. 18, 2014

(51) Int. Cl.

| | |
|---|---|
| ***H01H 85/08*** | (2006.01) |
| ***H01H 85/143*** | (2006.01) |
| ***H01H 85/175*** | (2006.01) |
| *H01H 85/38* | (2006.01) |
| *H01H 85/50* | (2006.01) |
| *H01H 85/18* | (2006.01) |

(52) U.S. Cl.

CPC ..... *H01H 85/08* (2013.01); *H01H 85/143* (2013.01); *H01H 85/175* (2013.01); *H01H 85/18* (2013.01); *H01H 85/38* (2013.01); *H01H 85/50* (2013.01); *H01H 2085/381* (2013.01); *H01H 2085/383* (2013.01)

(58) Field of Classification Search

CPC .. H01H 85/50; H01H 85/143; H01H 85/175; H01H 2085/381; H01H 2085/383; H01H 85/08; H01H 85/18; H01H 85/38

USPC ..... 337/295

See application file for complete search history.

(56) References Cited

U.S. PATENT DOCUMENTS

| | | | | |
|---|---|---|---|---|
| 3,261,951 | A | 7/1966 | Jacobs | |
| 4,045,757 | A | 8/1977 | Johnson | |
| 4,376,927 | A * | 3/1983 | McGalliard | H01H 85/046 174/254 |
| 4,414,526 | A * | 11/1983 | Panaro | 337/163 |
| 4,608,548 | A | 8/1986 | Borzoni | |
| 5,153,553 | A * | 10/1992 | Ruehl | H01H 85/38 337/273 |
| 5,229,739 | A * | 7/1993 | Oh et al. | 337/290 |
| 5,606,301 | A | 2/1997 | Ishimura | |
| 6,534,726 | B1 | 3/2003 | Okada et al. | |
| 2004/0183646 | A1* | 9/2004 | Jollenbeck et al. | 337/228 |
| 2004/0184211 | A1* | 9/2004 | Bender et al. | 361/104 |
| 2005/0035841 | A1* | 2/2005 | Kobayashi et al. | 337/157 |
| 2005/0057337 | A1* | 3/2005 | Richter et al. | 337/187 |
| 2005/0141164 | A1 | 6/2005 | Bender et al. | |
| 2006/0066436 | A1 | 3/2006 | Langhoff et al. | |
| 2006/0170528 | A1* | 8/2006 | Fukushige | H01H 85/0411 337/297 |
| 2010/0289612 | A1 | 11/2010 | Chiu | |

FOREIGN PATENT DOCUMENTS

| | | | |
|---|---|---|---|
| JP | 2006244948 | A | 9/2006 |

* cited by examiner

*Primary Examiner* — Anatoly Vortman
*Assistant Examiner* — Jacob Crum

(57) ABSTRACT

A compact, high breaking capacity fuse that includes a top insulative layer, at least one intermediate insulative layer, and a bottom insulative layer arranged in a vertically stacked configuration. The at least one intermediate layer may have a hole formed therethrough that defines an air gap within the fuse. A first conductive terminal may be formed on a first end of the fuse and a second conductive terminal may be formed on a second end of the fuse. At least one fusible element may connect the first terminal to the second terminal, thus providing an electrically conductive pathway therebetween. A portion of the at least one fusible element may pass through the air gap defined by the hole in the at least one intermediate insulative layer.

2 Claims, 4 Drawing Sheets

LAMINATED ELECTRICAL FUSE

FIELD OF THE DISCLOSURE

The disclosure relates generally to the field of circuit protection devices and more particularly to a compact, low cost, high breaking capacity fuse.

BACKGROUND OF THE DISCLOSURE

In many circuit protection applications it is desirable to employ fuses that are compact and that have high "breaking capacities." Breaking capacity (also commonly referred to as "interrupting capacity") is the current that a fuse is able to interrupt without being destroyed or causing an electric arc of unacceptable duration. Certain fuses sold under the name NANO fuse are currently available that exhibit high breaking capacities and are suitable for compact applications, but such fuses are relatively expensive. It is therefore desirable to provide a low cost, high breaking capacity fuse that is suitable for compact circuit protection applications.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

In accordance with the present disclosure, a compact, high breaking capacity fuse is provided. An exemplary embodiment of the fuse may include a top insulative layer, at least one intermediate insulative layer, and a bottom insulative layer arranged in a vertically stacked and bonded configuration. The at least one intermediate layer may have a hole formed therethrough that defines an air gap within the fuse. A first conductive terminal may be formed on a first end of the fuse and a second conductive terminal may be formed on a second end of the fuse. At least one fusible element may connect the first terminal to the second terminal, thus providing an electrically conductive pathway therebetween. A portion of the at least one fusible element may pass through the air gap defined by the hole in the at least one intermediate insulative layer.

DETAILED DESCRIPTION

Figure 1:
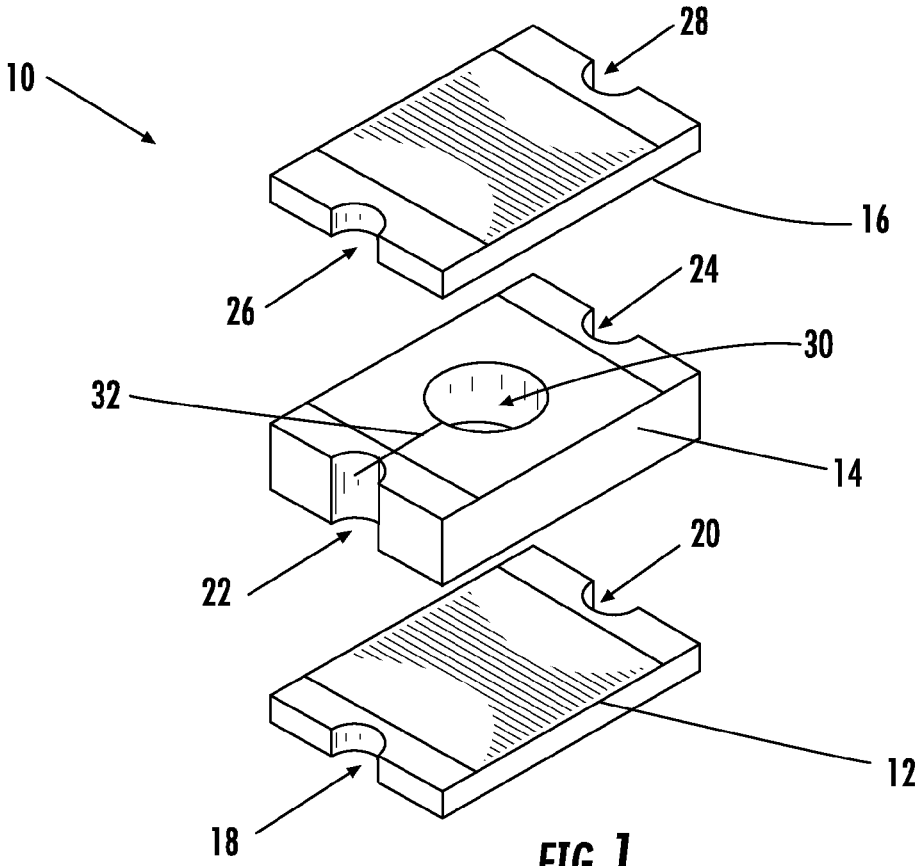
FIG. 1 is an exploded view illustrating a high breaking capacity fuse in accordance with an exemplary embodiment of the present disclosure.

The present invention will now be described more fully hereinafter with reference to the accompanying drawings, in which preferred embodiments of the invention are shown. This invention, however, may be embodied in many different forms and should not be construed as being limited to the embodiments set forth herein. Rather, these embodiments are provided so that this disclosure will be thorough and complete, and will fully convey the scope of the invention to those skilled in the art. In the drawings, like numbers refer to like elements throughout.

Figure 2:
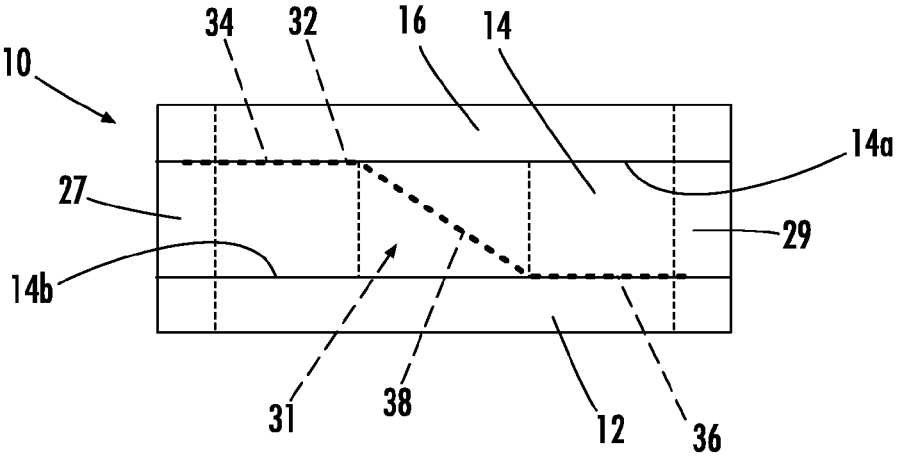
FIG. 2 is a side view illustrating the high breaking capacity fuse shown in FIG. 1 in an assembled configuration.

Referring to FIGS. 1 and 2, a first exemplary embodiment of a high breaking capacity fuse 10 (hereinafter referred to as "the fuse 10") in accordance with the present disclosure is shown. The fuse 10 is shown exploded in FIG. 1 and in a fully assembled configuration in FIG. 2. The fuse 10 may include a bottom insulative layer 12, a middle insulative layer 14, and a top insulative layer 16 disposed in a vertically stacked configuration. When assembled as shown in FIG. 2, the layers 12-16 may be flatly bonded to each other, such as with epoxy or other non-conductive adhesives or fasteners. The layers 12-16 may be substantially rectangular and may be formed of any suitable, electrically insulative material, including, but not limited to, FR-4, glass, ceramic, plastic, etc.

The layers 12-16 of the fuse 10 may have castellations 18, 20, 22, 24, 26, and 28 at their longitudinal ends, such as may be formed by drilling, for providing the assembled fuse 10 with terminals 27 and 29. The longitudinal ends of the layers 12-16 may plated with copper or other electrically conductive materials, such as by a photolithography process or other plating means, to facilitate electrical connection between the terminals 27 and 29 of the assembled fuse and other circuit elements.

The layers 12-16 may be substantially identical, except that the middle layer 14 may be provided with a through-hole 30 formed in a center portion thereof that defines an air gap 31 in the assembled fuse 10. The hole 30 is shown having a circular shape, but it is contemplated that the hole 30 may be formed with a variety of other shapes, such as oval, rectangular, triangular, or irregular. The middle layer 14 may also be thicker than the bottom layer 12 and the top layer 16 as shown in the figures, but this is not critical. It is contemplated that that middle layer 14 may alternatively be thinner or may have the same thickness as the bottom layer 12 and top layer 16. It is further contemplated that the bottom layer 12 or the top layer 16 may be thinner or thicker than the other two layers.

The fuse 10 may include a fusible element 32 disposed intermediate the layers 12-16. Particularly, a first end portion 34 of the fusible element 32 may be disposed on a top surface 14*a* of the middle layer 14 and a bottom surface of the top layer 16. A second end portion 36 of the fusible element 32 may be disposed on a bottom surface 14*b* of the middle layer 14 and a top surface of the bottom layer 12. A middle portion 38 of the fusible element 32 may extend diagonally through the hole 30 which defines the air gap 31 in the middle layer 14. The end portions 34 and 36 may be bonded to the plated, longitudinal ends of the layers 12-16, such as by solder or conductive adhesive. The fusible element 32 thereby provides an electrically conductive pathway between the terminals 27 and 29.

The middle portion 38 of the fusible element 32 is a "weak point" that will predictably separate upon the occurrence of an overcurrent condition in the fuse 10. Since the middle portion 38 is entirely surrounded by air and is not in contact with, or in close proximity to, the insulative material that forms the layers 14-16, an electric arc that forms in the middle portion 38 during an overcurrent condition is deprived of fuel (i.e. surrounding material) that might otherwise sustain the arc. Arc time is thereby reduced, which in-turn increases the breaking capacity of the fuse 10.

The fusible element 32 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. As will be appreciated by those of ordinary skill in the art, the particular size, configuration, and conductive material of the fusible element 32 may all contribute to the rating of the fuse 10.

Figure 3:
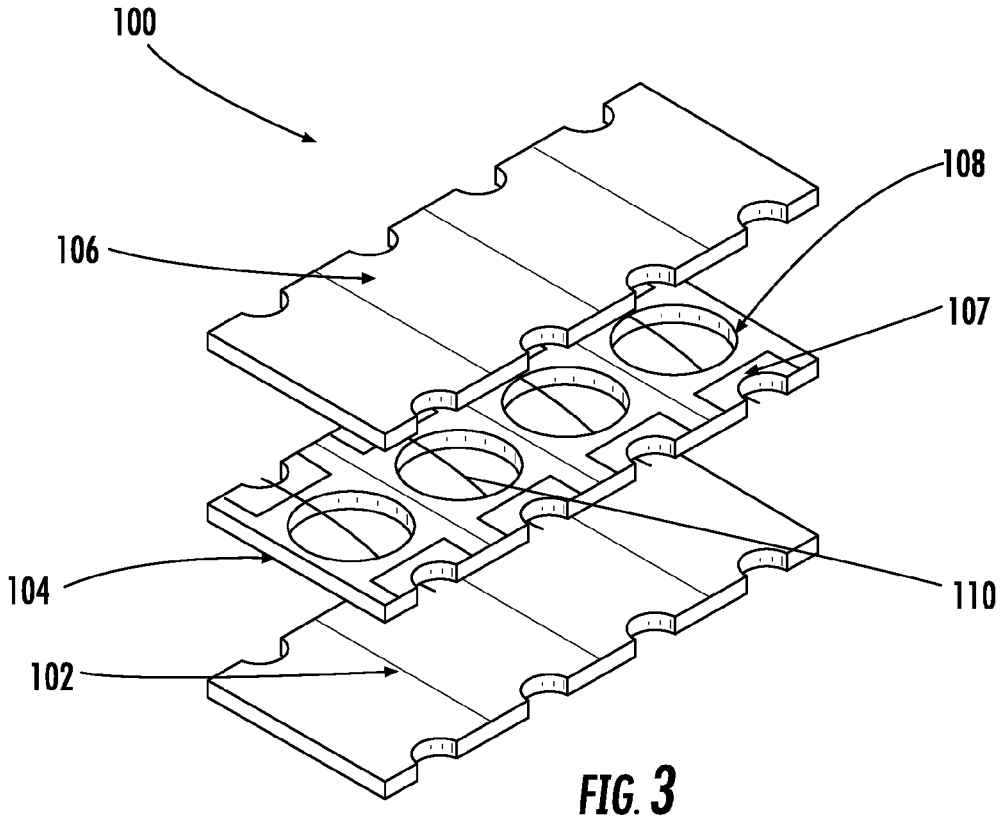
FIG. 3 is an exploded view illustrating a fuse array in accordance with the present disclosure wherein several high breaking capacity fuses are arranged in a contiguous, arrayed configuration.
Figure 4:
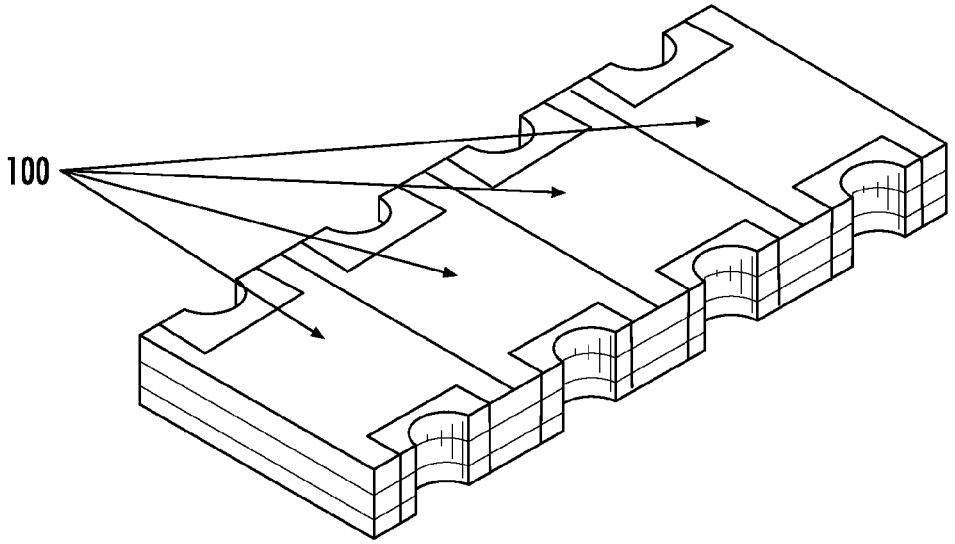
FIG. 4 is a perspective view illustrating the high breaking capacity fuse array shown in FIG. 3 in an assembled configuration.

Referring to FIGS. 3 and 4, it is contemplated that several fuses 100 that are substantially identical to the fuse 10 described above may be formed of a single, contiguous bottom layer 102, a single, contiguous middle layer 104, and a single, contiguous top layer 106. Each of the layers 102-106 may have castellations 107 as described above. Like the fuse 10, each of the fuses 100 may have a hole 108 formed through the intermediate or middle layer 104 thereof and a fusible element 110 extending diagonally through the hole 108 for providing enhanced breaking capacity. It is contemplated that the fusible elements 110 may all be identical, or that some or all of the fusible elements 110 may have different configurations and/or ratings relative to others. The fuses 100 are shown in a 4×1 arrayed configuration in FIGS. 3 and 4, but it is contemplated that larger or smaller arrays (e.g. 2×1, 6×1, etc.) with more or fewer fuses 100 may be implemented in a similar manner without departing from the scope of the present disclosure.

Figure 5:
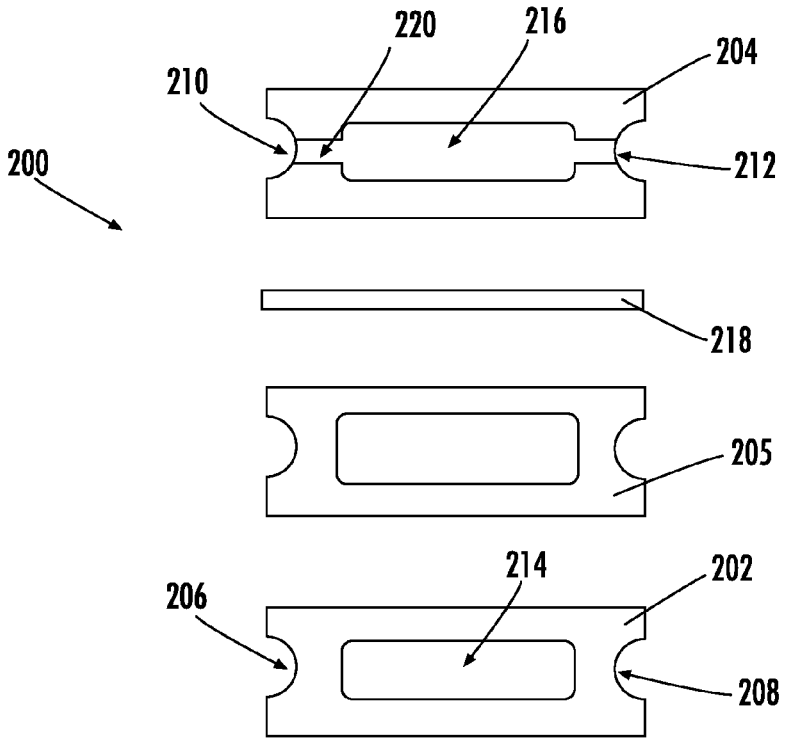
FIG. 5 is plan view illustrating components of an alternative high breaking capacity fuse embodiment in accordance with the present disclosure.

FIG. 5 illustrates an exploded view of a fuse 200 in accordance with an alternative embodiment of the present disclosure. The fuse 200 may include a bottom insulative layer 202 and a top insulative layer 204. When the fuse 200 is assembled (not shown) the layers 202 and 204 may be flatly bonded to each other in a vertically stacked configuration, such as with an intermediate layer 205 of epoxy, pre-preg, or with other non-conductive adhesives or fasteners. As shown, the intermediate layer 205 has a similar configuration as layers 202 and 204, however alternative configurations are contemplated herein. The layers 202 and 204 may be substantially rectangular and may be formed of any suitable, electrically insulative material, including, but not limited to, FR-4, glass, ceramic, plastic, etc.

The layers 202 and 204 may have castellations 206, 208, 210, and 212 at their longitudinal ends, such as may be formed by drilling, for providing the assembled fuse 200 with terminals for connection to other circuit elements. The bottom layer 202 may be provided with a routed area 214 on its top surface, and the top layer 204 may be provided with a routed area 216 on its bottom surface. When the fuse 200 is assembled, the routed areas 214 and 216 align with one another to define a central air gap or chamber within the fuse 200. The routed areas are shown as being rectangular in shape, but it is contemplated that the routed areas 214 and 216 may be formed with a variety of other shapes, such as circular, oval, triangular, or irregular.

The fuse 200 includes a fusible element 218 disposed intermediate the layers 202 and 204. Particularly, the longitudinal ends of the fusible element 218 may be disposed within a routed channel 220. The channel 220 is shown as being formed in the top layer 204, but it is contemplated that the channel 220 can alternatively be formed in the bottom layer 202, or that similar channels can be formed in the both the top and bottom layers 202 and 204. In any such configuration, the routed channel(s) may be shallower than the routed areas 214 and 216, and may be of a size and shape that accommodate the fusible element 218 in a close clearance relationship.

When the fuse 200 is assembled, a central portion of the fusible element 218 extends through the air gap defined by the routed portions 214 and 216. The central portion of the fusible element 218 is therefore entirely surrounded by air within the fuse 200, which thereby increases the breaking capacity of the fuse 200 for the reasons described above. Unlike the fusible element 32 described above with reference to FIGS. 1 and 2, the fusible element 218 extends longitudinally straight (i.e. not diagonally) across the fuse 200. The fusible element 218 may be formed of any suitable, electrically conductive material, such as copper or tin, and may be formed as a wire, a ribbon, a metal link, a spiral wound wire, a film, an electrically conductive core deposited on a substrate, or any other suitable structure or configuration for providing a circuit interrupt. As will be appreciated by those of ordinary skill in the art, the particular size, configuration, and conductive material of the fusible element 218 may all contribute to the rating of the fuse 200.

Figure 6:
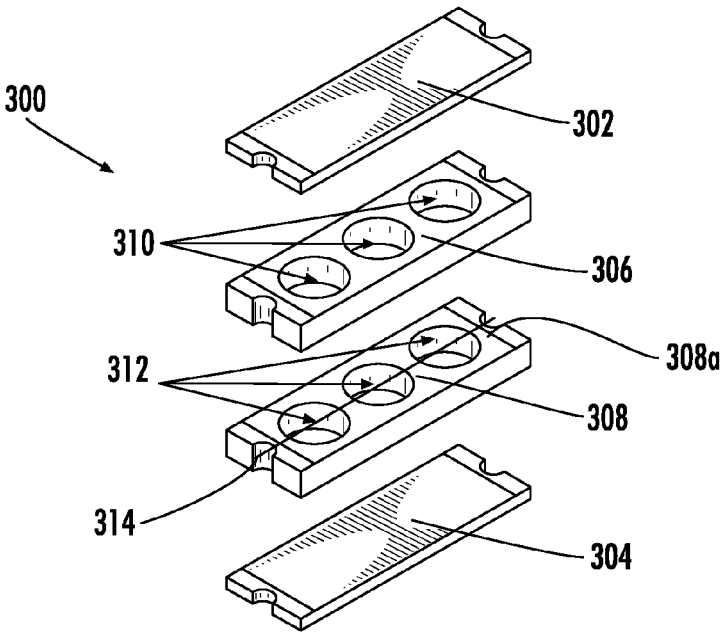
FIG. 6 is an exploded view illustrating another alternative high breaking capacity fuse embodiment in accordance with the present disclosure.

A fuse 300 is shown in the exploded view of FIG. 6 that is substantially similar to the fuse 200 shown in FIG. 5 except that instead of the top and bottom layers 302 and 304 having routed areas formed therein, the fuse 300 is provided with intermediate layers 306 and 308 having holes 310 and 312 formed therethrough. When the fuse 300 is assembled in a vertically stacked configuration, the holes 310 are aligned with the holes 312 and thus define a series of air gaps or chambers within the fuse. The fusible element 314 is disposed on a top surface 308*a* of intermediate layer 308 and a bottom surface of intermediate layer 306 such that the fusible element extends along the air gaps 310 and 312 and thus provides the fuse 300 with an enhanced breaking capacity as described above. The intermediate layers 306 and 308 are each shown as having three holes 310 and 312 formed therethrough, but it is contemplated that more or fewer holes having alternative shapes may be formed in a similar manner without departing from the present disclosure.

Figure 7:
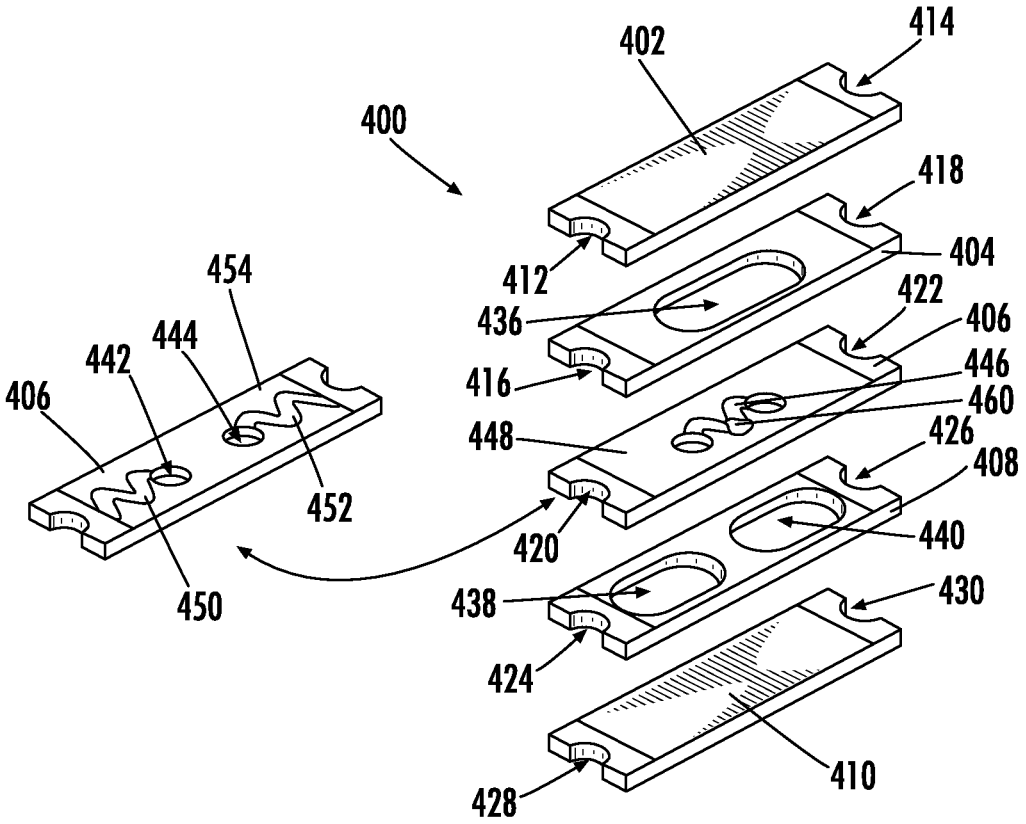
FIG. 7 is an exploded view illustrating yet another alternative high breaking capacity fuse embodiment in accordance with the present disclosure.
Figure 8:
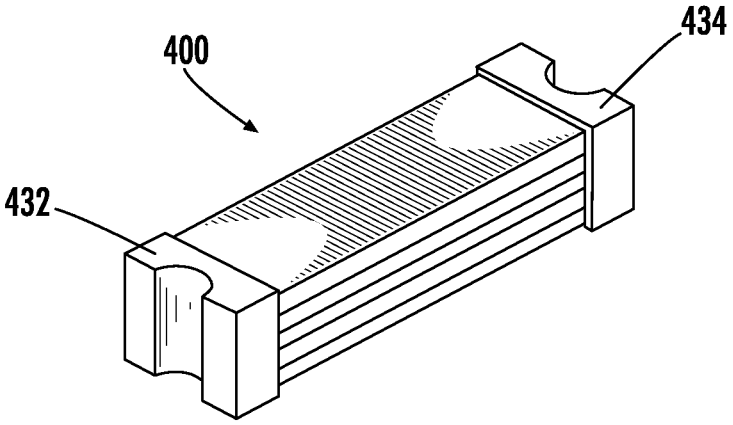
FIG. 8 is a perspective view illustrating the high breaking capacity fuse shown in FIG. 7 in an assembled configuration.

Referring to FIGS. 7 and 8, a fuse 400 in accordance with an alternative embodiment of the present disclosure is shown. FIG. 7 is an exploded view of the fuse 400 and FIG. 8 illustrates a fully assembled configuration. The fuse 400 may include a first insulative layer 402, a second insulative layer 404, a third insulative layer 406, a fourth insulative layer 408, and a fifth insulative layer 410 disposed in a vertically stacked configuration. When assembled as shown in FIG. 8, the layers 402-410 may be flatly bonded to each other, such as with epoxy, pre-preg, or with other non-conductive adhesives or fasteners. The layers 402-410 may be substantially rectangular and may be formed of any suitable, electrically insulative material, including, but not limited to, FR-4, glass, ceramic, plastic, etc.

The layers 402-410 may have castellations 412, 414, 416, 418, 420, 422, 424, 426, 428, and 430 at their longitudinal ends, such as may be formed by drilling, for providing the assembled fuse 400 with terminals 432 and 434. The longitudinal ends of the layers 412-430 may be plated with copper or other electrically conductive materials, such as by a photolithography process or other plating means, to define terminals 432, 434 at respective longitudinal ends of the fuse 400 to facilitate electrical connection with other circuit elements. The terminals 432 and 434 of the assembled fuse 400 may be further plated or coated with conductive materials, such as by dipping or by electroless plating techniques.

Insulative layer 404 may have a hole 436 formed therethrough and the layer 408 may have two longitudinally-spaced holes 438 and 440 formed therethrough. The holes 436-440 are shown as having an oblong shape, but it is contemplated that the holes 436-440 may be formed with a variety of other shapes, such as circular, oval, rectangular, triangular, or irregular. When the fuse 400 is assembled, the hole 436 in the layer 404 may define an air gap or chamber between the layers 402 and 406, and the holes 438 and 440 in the layer 408 may define longitudinally-spaced air gaps between the layers 406 and 410.

The layer 406 of the fuse 400 may have a pair of longitudinally-spaced vias 442 and 444 formed therethrough. The interior surfaces of the vias 442 and 444 may be plated or coated with an electrically conductive material, such as copper. A fusible element 446 may be formed on the top surface 448 (shown on the right side on FIG. 7) of the layer 406, intermediate and electrically connected to the vias 442 and 444. Similarly, fusible elements 450 and 452 may be formed on the bottom surface 454 (shown on the left side on FIG. 7) of the layer 406, intermediate and electrically connected to the vias 442 and 444 and the plated, longitudinal ends of the layer 406. The fusible elements 446, 450, and 452 and the vias 442 and 44 thus provide an electrical pathway between the terminals 432 and 434 of the assembled fuse 400.

When the fuse 400 is assembled, the top surface of the fusible element 446 may be disposed within the air gap defined by the hole 436 in the layer 404, and the bottom surfaces of the fusible elements 450 and 452 may be disposed within the air gaps defined by the holes 438 and 440 in the layer 408. Since these surfaces of the of the fusible elements 446, 450, and 452 are not in contact with, and are not in close proximity to, the insulative material that forms the layers 404 and 408, an electric arc that forms in one or more of the fusible elements 446, 450, and 452 during an overcurrent condition is deprived of fuel (i.e. surrounding material) that might otherwise sustain the arc. Arc time is thereby reduced, which in-turn increases the breaking capacity of the fuse 400.

The fusible elements 446, 450, and 452 may be formed of any suitable, electrically conductive material, such as copper or tin, and may be formed using any suitable plating, coating, or material deposition means, such as by a photolithography process. The fusible elements 446, 450, and 452 are shown in FIG. 7 as having a serpentine shape, but this is not critical. As will be appreciated by those of ordinary skill in the art, the particular size, configuration, shape and conductive material of the fusible elements 446, 450, 452 may all contribute to the rating of the fuse 400. In addition, a portion 460 formed of a material having a lower melting point than the fusible elements 446, 450, and 452 may be formed on one or more of the fusible elements 446, 450, and 452 for creating a "weak point" that will predictably open upon the occurrence of an overcurrent condition in the fuse 400 associated with a particular rating. For example, the portion 460 may be formed of tin with a nickel barrier.

As used herein, an element or step recited in the singular and proceeded with the word "a" or "an" should be understood as not excluding plural elements or steps, unless such exclusion is explicitly recited. Furthermore, references to "one embodiment" of the present invention are not intended to be interpreted as excluding the existence of additional embodiments that also incorporate the recited features.

While the present invention has been disclosed with reference to certain embodiments, numerous modifications, alterations and changes to the described embodiments are possible without departing from the sphere and scope of the present invention, as defined in the appended claim(s). Accordingly, it is intended that the present invention not be limited to the described embodiments, but that it has the full scope defined by the language of the following claims, and equivalents thereof.

The invention claimed is:

1. A high breaking capacity fuse comprising:

a top insulative layer, a first intermediate insulative layer, a middle insulative layer, a second intermediate insulative layer, and a bottom insulative layer arranged in a vertically stacked configuration, the first intermediate insulative layer includes a first hole formed therethrough, the second intermediate insulative layer includes a pair of longitudinally-spaced holes formed therethrough, wherein the top insulative layer, the bottom insulative layer, the first intermediate insulative layer, second intermediate insulative layer, and middle insulative layer are each flatly bonded to each other;

a first air gap defined by the first hole and extending between the top insulative layer and middle insulative layer;

a second and third air gap defined by the pair of longitudinally spaced holes and extending between the bottom insulative layer and the middle insulative layer;

a first conductive terminal formed on a first end of the vertically stacked configuration;

a second conductive terminal formed on a second end of the vertically stacked configuration;

a first fusible element formed on a top surface of the middle insulative layer; and a second fusible element and third fusible element formed on a bottom surface of the middle insulative layer, wherein the first fusible element, second fusible element and third fusible element form part of an electrical path between the first conductive terminal and second conductive terminal.

2. The high breaking capacity fuse of claim 1 wherein at least one of the first fusible element, second fusible element and third fusible element has a serpentine shape at least partially between the first and second terminals.

* * * * *